US010847308B2

(12) United States Patent
Jung et al.

(10) Patent No.: US 10,847,308 B2
(45) Date of Patent: Nov. 24, 2020

(54) COIL COMPONENT

(71) Applicant: SAMSUNG ELECTRO-MECHANICS CO., LTD., Suwon-si (KR)

(72) Inventors: Ji Hyung Jung, Suwon-si (KR); Byeong Cheol Moon, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 277 days.

(21) Appl. No.: 15/860,061

(22) Filed: Jan. 2, 2018

(65) Prior Publication Data

US 2018/0350509 A1 Dec. 6, 2018

(30) Foreign Application Priority Data

Jun. 1, 2017 (KR) ..... 10-2017-0068537
Jul. 13, 2017 (KR) ..... 10-2017-0089090

(51) Int. Cl.

| | |
|---|---|
| ***H01F 27/28*** | (2006.01) |
| ***H01F 27/24*** | (2006.01) |
| ***H01F 27/32*** | (2006.01) |
| ***H01F 27/29*** | (2006.01) |
| ***H01F 17/00*** | (2006.01) |
| *H01F 17/04* | (2006.01) |

(52) U.S. Cl.

CPC ..... *H01F 27/2828* (2013.01); *H01F 17/0013* (2013.01); *H01F 27/24* (2013.01); *H01F 27/29* (2013.01); *H01F 27/292* (2013.01); *H01F 27/324* (2013.01); *H01F 2017/048* (2013.01)

(58) Field of Classification Search

USPC ..... 336/200, 223, 233, 192
See application file for complete search history.

(56) References Cited

U.S. PATENT DOCUMENTS

2016/0172103 A1 6/2016 Jeong et al.
2016/0189840 A1* 6/2016 Ahn ..... H01F 27/255 336/192
2018/0286561 A1* 10/2018 Shimoichi ..... H01F 17/0013

FOREIGN PATENT DOCUMENTS

| | | | |
|---|---|---|---|
| JP | 11-204337 | A | 7/1999 |
| JP | 2009-295927 | A | 12/2009 |
| JP | 2012-015493 | A | 1/2012 |
| JP | 2016-004917 | A | 1/2016 |
| KR | 10-2016-0014302 | A | 2/2016 |
| KR | 10-2016-0081054 | A | 7/2016 |
| KR | 10-1709841 | B1 | 2/2017 |

OTHER PUBLICATIONS

Office Action issued in corresponding Japanese Patent Application No. 2018-001110, dated Aug. 28, 2018.
Office Action issued in corresponding Korean Patent Application No. 10-2017-0089090, dated Aug. 6, 2018.

* cited by examiner

*Primary Examiner* — Elvin G Enad
*Assistant Examiner* — Kazi S Hossain
(74) *Attorney, Agent, or Firm* — Morgan, Lewis & Bockius LLP

(57) ABSTRACT

A coil component includes: an internal coil including a coil body and first and second lead portions; and first and second external electrodes electrically connected to the internal coil. At least one of the first and second lead portions may include first and second lead wires and at least one extension wire connected to at least one of the first and second lead wires and directly connected to the external electrode.

18 Claims, 9 Drawing Sheets

COIL COMPONENT

CROSS-REFERENCE TO RELATED APPLICATION(S)

This application claims benefit of priority to Korean Patent Application Nos. 10-2017-0068537 filed on Jun. 1, 2017 and 10-2017-0089090 filed on Jul. 13, 2017 in the Korean Intellectual Property Office, the disclosure of which is incorporated herein by reference in its entirety.

TECHNICAL FIELD

The present disclosure relates to a coil component and more particularly, to a thin-film type power inductor.

BACKGROUND

In accordance with the recent development of portable wireless communications devices and wearable devices, a component having high performance, a reduced thickness, and a small size has been required. Particularly, in recent portable smartphones and wearable devices, a usage frequency has increased, and there is a need to stably supply power in a use frequency region. Therefore, in accordance with the development of the smartphones and wearable devices, as a power inductor having a function of suppressing a rapid change in current in a power supply terminal, a power inductor capable of being used at a high frequency and with high current has been required.

However, as an area of an exposed portion of an external electrode is decreased in order to secure uniformity of a plating thickness of an internal coil pattern, direct current resistance (Rdc) is increased due to a decrease in a contact area with the external electrode of a chip, such that overall chip characteristics may be deteriorated.

SUMMARY

An aspect of the present disclosure may provide a coil component capable of improving contact properties between an external electrode and an internal coil while decreasing a contact area between the external electrode and a lead wire of the internal coil, and capable of preventing over-plating in the vicinity of the lead wire of the internal coil.

According to an aspect of the present disclosure, a coil component may include: a body including a support member, an internal coil, and a magnetic material encapsulating the support member and the internal coil; and first and second external electrodes disposed on an external surface of the body. The internal coil may include a coil body and first and second lead portions connected to one end portion and the other end portion of the coil body, respectively. The first lead portion may include first and second lead wires spaced apart from each other in a width direction and an opening portion formed by the first and second lead wires and the coil body, the opening portion being filled with the magnetic material. The first lead portion may include at least one extension wire extending in a region between the first and second lead wires, and connected to the first external electrode.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Hereinafter, exemplary embodiments of the present disclosure will now be described in detail with reference to the accompanying drawings.

Hereinafter, a coil component according to an exemplary embodiment in the present disclosure will be described, but is not necessarily limited thereto.

Coil Component

Figure 1:
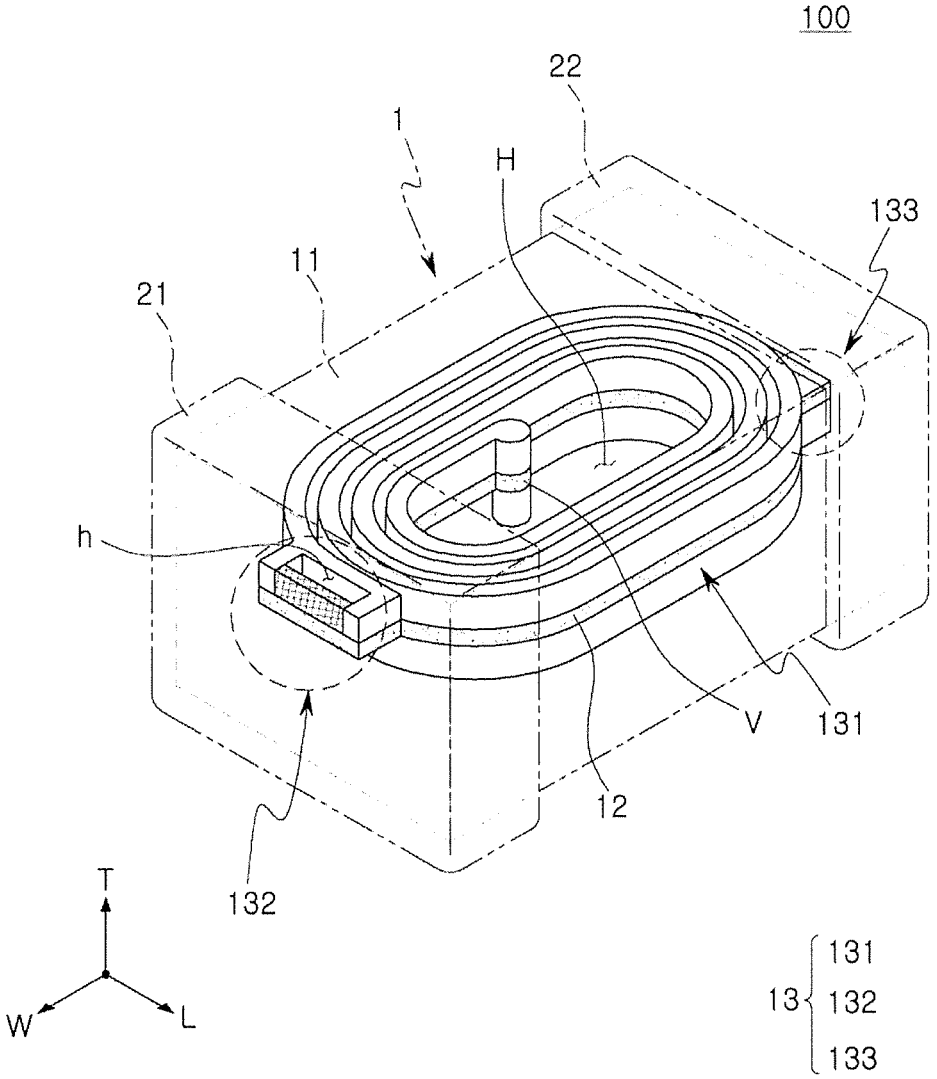
FIG. 1 is a schematic perspective view of a coil component according to an exemplary embodiment in the present disclosure.
Figure 2:
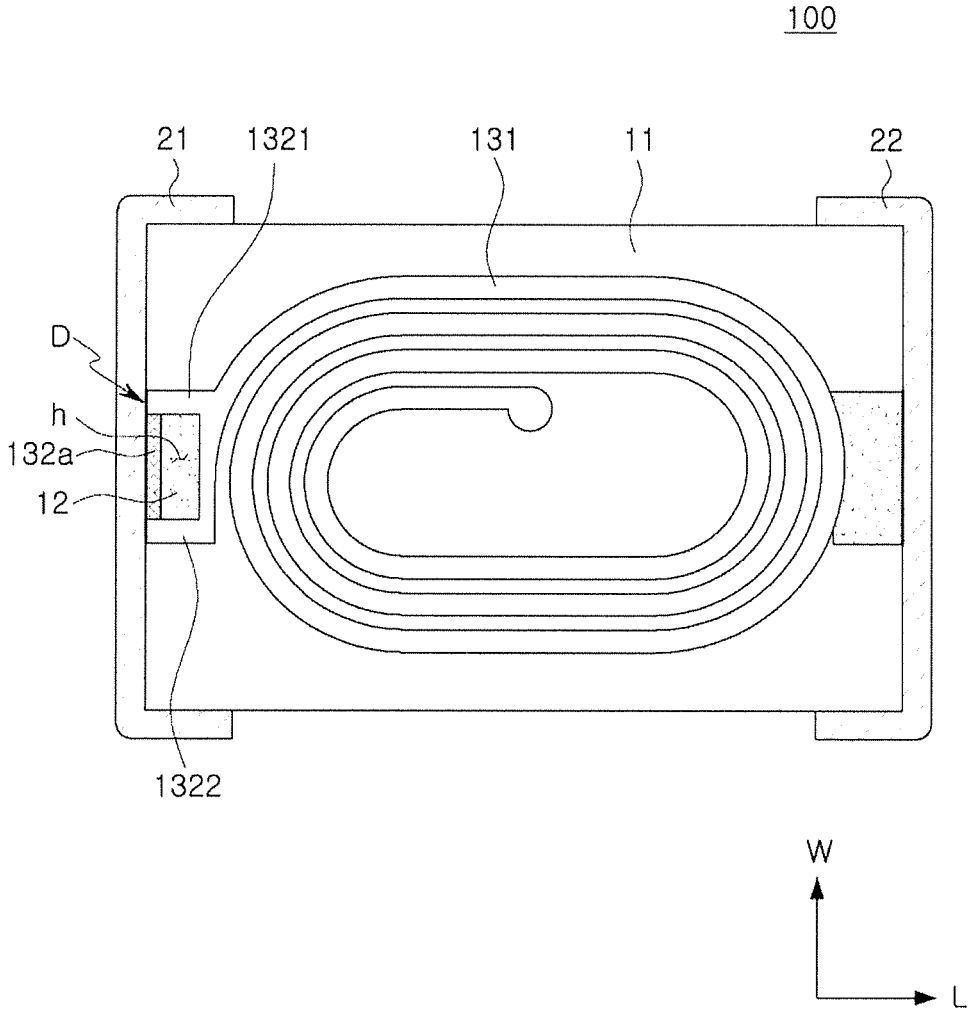
FIG. 2 is a schematic top view of FIG. 1.

FIG. 1 is a schematic perspective view of a coil component according to an exemplary embodiment in the present disclosure, and FIG. 2 is a schematic top view of FIG. 1.

Referring to FIGS. 1 and 2, a coil component 100 according to the exemplary embodiment in the present disclosure may include a body 1 and first and second external electrodes 21 and 22 disposed on an external surface of the body.

The body 1 may form an entire exterior of the coil component and have upper and lower surfaces opposing each other in a thickness (T) direction, first and second side surfaces opposing each other in a width (W) direction, and first and second end surfaces opposing each other in a length (L) direction to have a substantially hexahedral shape. However, the body 1 is not limited thereto.

The body 1 may include a magnetic material 11 having magnetic properties and a support member 12 and an internal coil 13, encapsulated by the magnetic material.

The magnetic material 11 may be, for example, a ferrite material or a metal based soft magnetic material. An example of the ferrite may include ferrite known in the art such as Mn—Zn based ferrite, Ni—Zn based ferrite, Ni—Zn—Cu based ferrite, Mn—Mg based ferrite, Ba based ferrite, Li based ferrite, or the like. The metal based soft magnetic material may be an alloy containing at least one selected from the group consisting of Fe, Si, Cr, Al, and Ni. For example, the metal based soft magnetic material may contain Fe—Si—B—Cr based amorphous metal particles, but is not limited thereto. The metal based soft magnetic material may have a particle diameter of 0.1 μm or more to 20 μm or less and be contained in a form in which the metal based soft magnetic material is dispersed in a polymer such as an epoxy resin, polyimide, or the like.

The support member 12 may be an element allowing the internal coil to be formed at a reduced thickness while supporting the internal coil, and may substantially have an overall shape corresponding to that of the internal coil supported by the support member. The support member 12 may be formed in a form of a plate having insulation properties. For example, the support member 12 may be a printed circuit board (PCB), but is not limited thereto. The support member 12 may have a thickness sufficient to support the internal coil. For example, the thickness of the support member 12 may preferably be about 60 μm. The support member may include a through hole H in a central portion thereof, and the through hole H may be filled with the magnetic material to serve as a magnetic core and increase permeability of the coil component.

Next, the internal coil 13 supported by the support member will be described. The internal coil 13 may include a coil body 131 having an entirely spiral shape and first and second lead portions 132 and 133 connected to one end portion and the other end portion of the coil body 131, respectively. The first lead portion 132 may be a portion positioned on the support member 11 and connected to the first external electrode 21 and the second lead portion 133 may be a portion positioned below the support member 11 and connected to the second external electrode 22. The first and second lead portions 132 and 133 may be electrically connected to each other through a via electrode V included in the support member 11. Further, since the first and second lead portions 132 and 133 are supported by the support member 11, although not illustrated in detail, the first and second lead portions 132 and 133 may each include abase layer serving as a seed pattern while directly contacting the support member 11 and a plating layer on the base layer. The plating layer may be suitably selected by those skilled in the art to thereby be formed of a combination of one or more selected from an anisotropic plating layer and an isotropic plating layer.

The first lead portion 132 may be formed to be substantially symmetrical to the second lead portion 133. Here, the first and second lead portions 132 and 133 are formed to be symmetrical to each other, which means that shapes, sizes, and the like, of the first and second lead portions 132 and 133 are equal to each other. Therefore, for convenience of explanation, the first lead portion 132 connected to the first external electrode 21 will be mainly described, but a description of the first lead portion 132 may also be equally applied to the second lead portion 133 connected to the second external electrode 22.

Referring to FIGS. 1 and 2, the first lead portion 132 may include first and second lead wires 1321 and 1322 spaced apart from each other in the width direction. Both of the first and second lead wires 1321 and 1322 may be directly connected to the coil body 131 and an opening portion h may be formed by the first and second lead wires 1321 and 1322 and the coil body 131. The magnetic material may be filled in the opening portion h. When a plating area is increased at the time of forming the first lead portion 132, there is a risk of over-plating, but the opening portion h may prevent the over-plating from occurring to allow a plating thickness to be uniform, while serving to enlarge a space in which the magnetic material may be filled.

One end portion of the first lead wire 1321 may be connected to the first external electrode 21, and the other end portion thereof may be connected to the coil body 131, such that the first lead wire 1321 may have an overall strip shape. One end portion of the second lead wire 1322 may be connected to the first external electrode 22, and the other end portion thereof may be connected to the coil body 131, such that the second lead wire 1322 may have an overall strip shape. The first and second lead wires 1321 and 1322 may have substantially the same shape as each other, and a length of the first lead wire 1321 may be longer than that of the second lead wire 1322.

In addition, a first extension wire 132*a* formed to be perpendicular to the first and second lead wires 1321 and 1322 may be further disposed between the first and second lead wires 1321 and 1322. The first extension wire 132*a* may have a shape of a strip extending in the width direction and may be formed to have substantially the same width as that of each of the first and second lead portions 132 and 133, but is not limited thereto. That is, the width of the first extension wire 132*a* may be suitably selected by those skilled in the art depending on process conditions. Although a case in which the first extension wire 132*a* has a boundary distinguished from the first and second lead wires 1321 and 1322 is illustrated for convenience of explanation, since the first extension wire 132*a* and the first and second lead wires 1321 and 1322 may be formed at once through the same plating process, it is preferable that boundary lines between the respective lead wires and the extension wire are not shown. Of course, in a case in which the first extension wire 132*a* is formed of a material different from that of the first and second lead wires 1321 and 1322 or formed by a different process, the boundary lines between the respective lead wires and extension wire may be confirmed.

Since cross-sectional areas of upper and lower surfaces of the first lead portion 132 are decreased by the opening portion formed by the first and second lead wires 1321 and 1322 together with the coil body 131 and an area of an exposed portion of the first lead portion 132 exposed to the outside is rather increased, a risk that over-plating and a deviation in plating thickness will occur may be decreased. However, when the opening portion h is formed by applying the first and second lead wires 1321 and 1322 to the first lead portion 132 as described above, as a contact area between the first lead portion and the first external electrode 21 is decreased, direct current resistance (Rdc) may be increased. However, since the coil component according to the present disclosure further includes the first extension wire 132*a*, the contact area between the first lead portion 132 and the first external electrode 21 may be sufficiently secured. As a result, a structure capable of simultaneously exhibiting an effect of preventing over-plating, a deviation in the plating thickness, and deterioration of direct current resistance (Rdc) characteristics and an effect of improving reliability by sufficiently securing the contact area may be suggested.

Referring to FIG. 2, a surface of the first extension wire 132*a* exposed to the outside of the body may be formed of a diced surface D, and in order to distinguish the diced surface from other external surfaces, the diced surface may be indicated by a thicker line. A width of the first extension wire 132*a*, in other words, a length of the first extension wire 132*a* extended in the length direction may be controlled by dicing. In a case in which a moving width of a dicing blade is similar or equal to a width of an initial first extension wire prepared in advance, in view of improving contact properties with the external electrode and securing plating thickness uniformity, it is advantageous to expose the diced surface as much as possible by disposing the first extension wire in parallel to the width direction.

Figure 3:
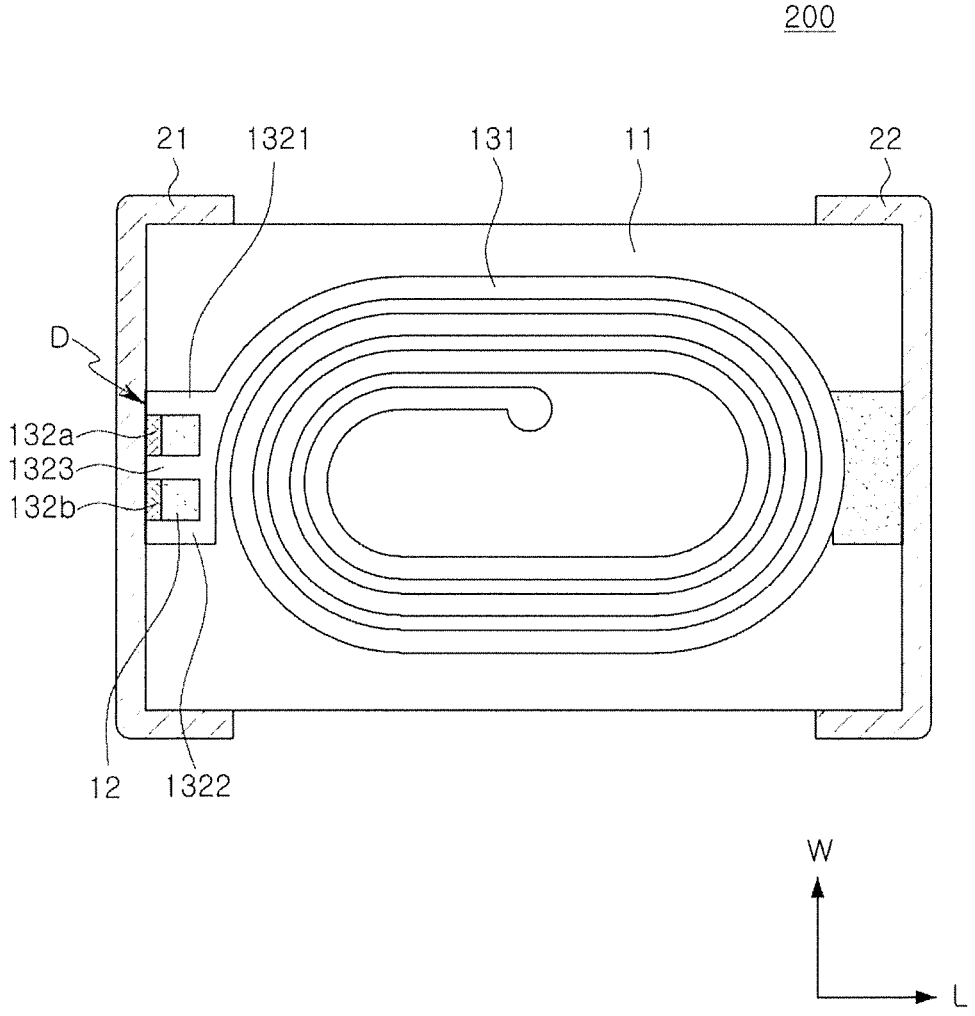
FIG. 3 is a top view of a coil component according to a first modified example of FIG. 2.

Next, a coil component 200 illustrated in FIG. 3 is different from the coil component 100 in FIG. 2, in that a third lead wire 1323 parallel to first and second lead wires 1321 and 1322 is further included between the first and second lead wires 1321 and 1322. For convenience of explanation, a description of configurations overlapping those of the coil component of FIGS. 1 and 2 will be omitted, and the same reference numerals will be used to describe substantially the same configurations.

Since the coil component 200 of FIG. 3 further includes the third lead wire 1323, a possibility that over-plating will occur at the time of plating growth of the lead portion of the internal coil may be further decreased. Further, there are advantages in that at the time of compressing a magnetic sheet or magnetic molding material on upper and lower surfaces of the internal coil 131, pressure applied to the lead portion may be further dispersed by the third lead wire 1323, and problems such as warpage of the lead portion, and the like, may be overcome. Although not illustrated in detail, a plurality of lead wires may be added between the first and second lead wires 1321 and 1322, widths of respective lead wires may be different from each other, and shapes thereof may also be changed to a wave shape, a V shape, or the like.

Further, at least one extension wire included in the coil component 200 of FIG. 3 may include first and second extension wires 132*a* and 132*b* spaced apart from each other in the width direction and may include a plurality of extension pieces. Here, although the first and second extension wires 132*a* and 132*b* are illustrated in a state in which they are spaced apart from each other by the third lead wire 1323, when the first and second extension wires 132*a* and 132*b* and the third lead wire 1323 are simultaneously formed using substantially the same material by a single process, boundary lines between the configurations may not be confirmed.

Figure 4A:
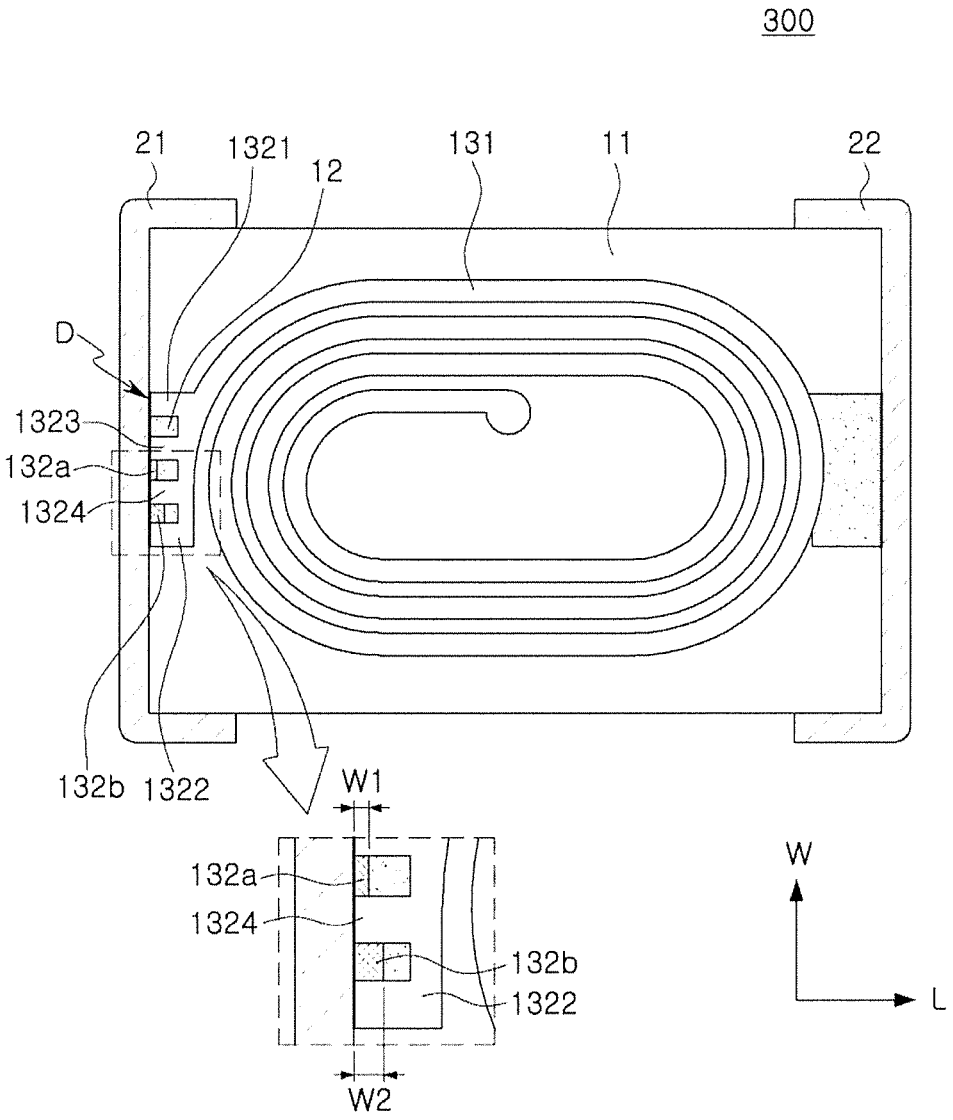
FIG. 4A is a top view of a coil component according to a second modified example of FIG. 2.
Figure 4B:
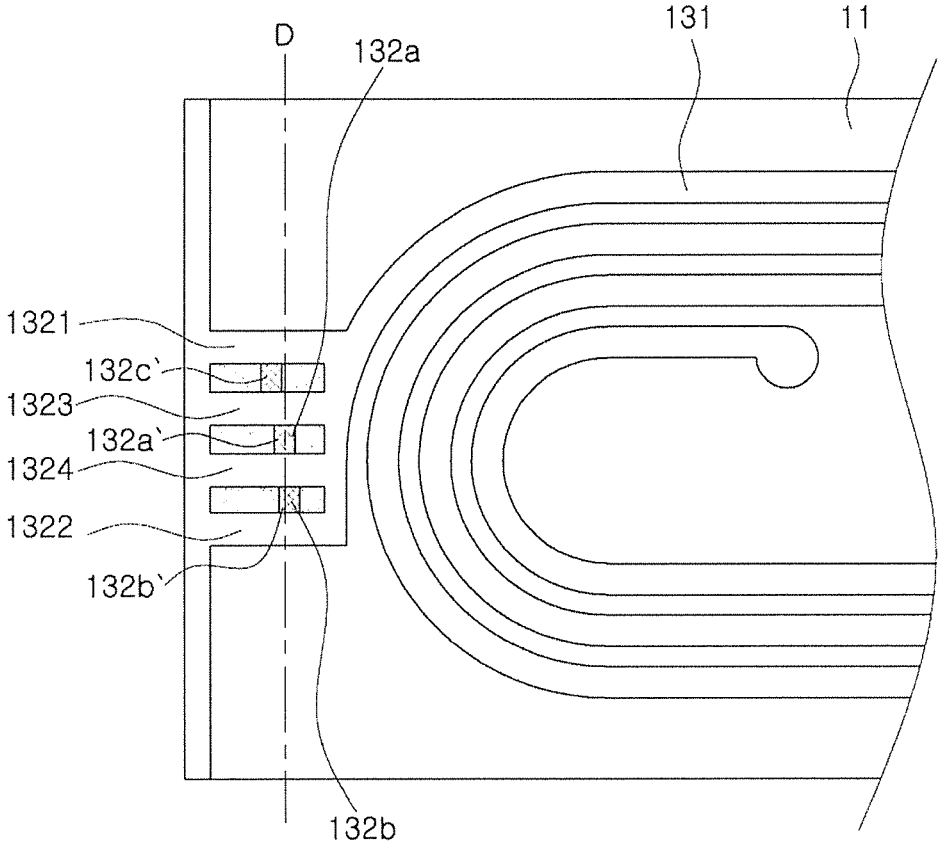
FIG. 4B is a portion of a schematic top view of FIG. 4A before dicing.

Next, FIG. 4A is a top view of a coil component 300 according to a second modified example of FIG. 2, and FIG. 4B is a portion of a schematic top view of FIG. 4A before dicing. Therefore, a dicing line D indicated by a dotted line is included in FIG. 4B. In describing FIGS. 4A and 4B, a description overlapping that of FIG. 2 will be omitted for convenience of explanation, and the same reference numerals will be used to describe substantially the same configurations.

Referring to FIG. 4A, the coil component 300 may include the third and fourth lead wires 1323 and 1324 parallel to first and second lead wires 1321 and 1322 between the first and second lead wires 1321 and 1322. The first to fourth lead wires 1321-1324 may be disposed to be parallel to each other in the length direction and to be spaced apart from each other by a predetermined interval in the width direction.

Further, the coil component 300 may further include first and second extension wires, 132*a* and 132*b*, disposed to be perpendicular to the first to fourth lead wires 1321-1324. The first extension wire 132*a* may be formed of an extension piece disposed to be discontinuous with the second extension wire 132*b*. The first extension wire may be disposed to be spaced apart from the second extension wire by a predetermined distance in the length and width directions. As an edge at which the first extension wire 1321 contacts the first external electrode 21 and an edge at which the second extension wire 1322 contacts the first external electrode 21, surfaces of the first and second extension wires 1321 and 1322 exposed to the outside of the body may be formed of a dicing surface D, and in order to distinguish the diced surface from other external surfaces, the diced surface may be indicated by a thicker line. A contact area between the first external electrode 21 and the first internal coil may be further increased and direct current resistance (Rdc) may be decreased by the edges at which the first and second extension wires 1321 and 1322 contact the first external electrode 21. A length of the first extension wire 132*a* in the length direction (that is, a width of the first extension wire: W1) may be shorter than a length of the second extension wire 132*b* in the length direction (that is, a width of the second extension wire: W2). Referring to FIG. 4B to be described below, the reason is that the second extension wire is disposed to be adjacent to the coil body as compared to the first extension wire before the dicing. The first extension wire may be further diced as compared to the second extension wire, such that a large portion of the first extension wire does not remain in the chip.

The diced surface of FIG. 4A will be described in more detail with reference to FIG. 4B. In FIG. 4B, a right side of the diced surface D may be a region remaining in a form of a chip after the dicing (the region corresponds to the coil component of FIG. 4A), and a left side thereof may be a region except for the chip after the dicing. As illustrated in FIG. 4B, except for the first and second extension wires remaining in the coil component 300, an extension portion 132*b*' of the second extension wire and a third extension wire 132*c*' may be further included. Here, since the extension portion of the second extension wire and the third extension wire are configurations removed after the dicing, in order to distinguish the extension portion of the second extension wire and the third extension wire from other configurations that will remain, a prime symbol (') is added to the reference numerals on right upper sides. The first to third extension wires 132*a*, 132*b*, 132*b*' and 132*c*' may be disposed to have an overall step shape with the first to fourth lead wires. The third extension wire of FIG. 4B may be a configuration capable of remaining in the chip in a case of further moving the diced surface to the left to increase a size of the chip in the length direction. In a case in which a plurality of extension pieces are disposed to be spaced apart from each other in a proceeding direction of a dicing blade when the dicing blade operates while moving in a length direction, a risk that any of the extension pieces will not be secured due to a moving width of the dicing blade that is greater than a wire width may be removed.

Figure 5A:
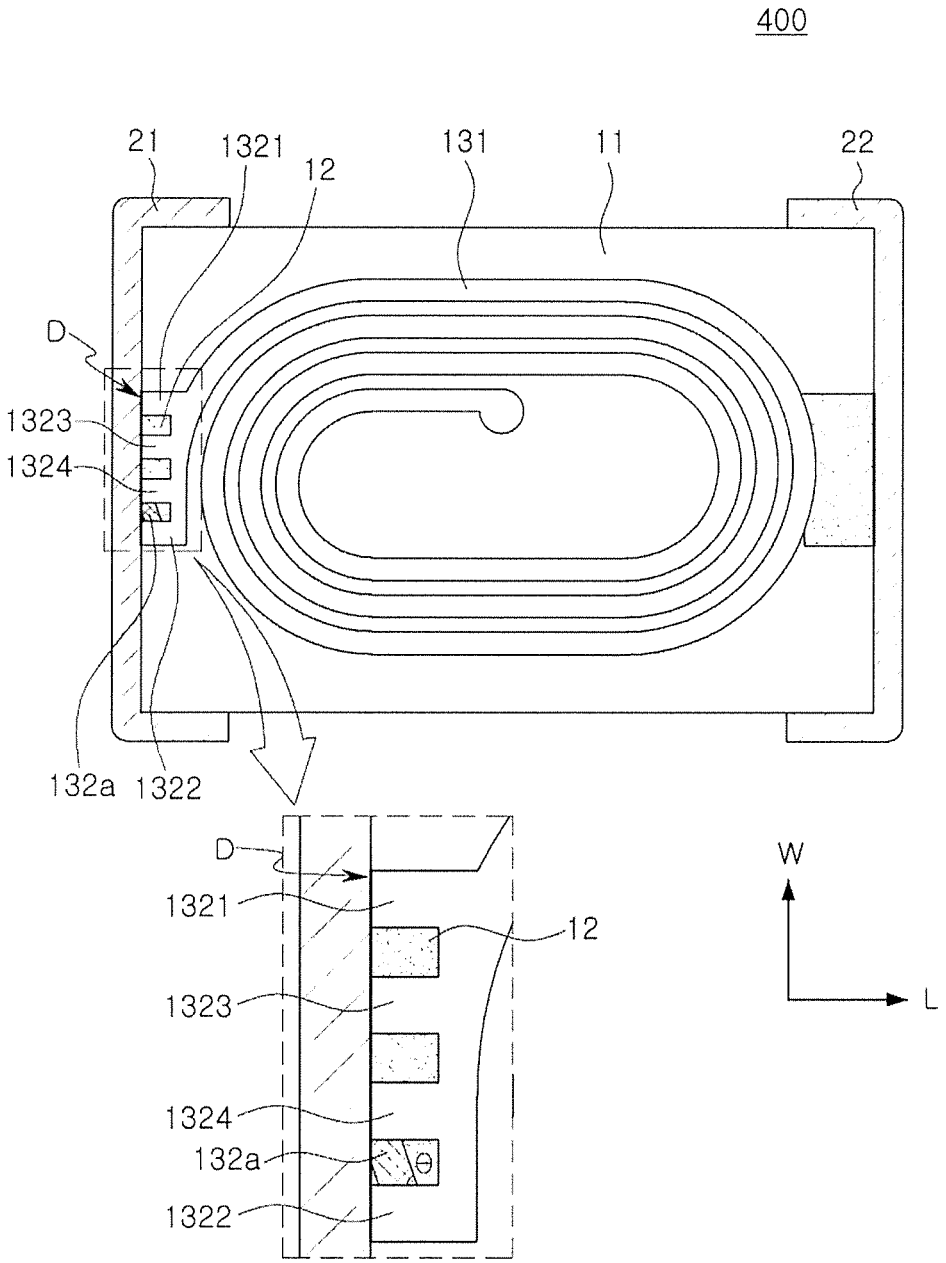
FIG. 5A is a top view of a coil component according to a third modified example of FIG. 2.
Figure 5B:
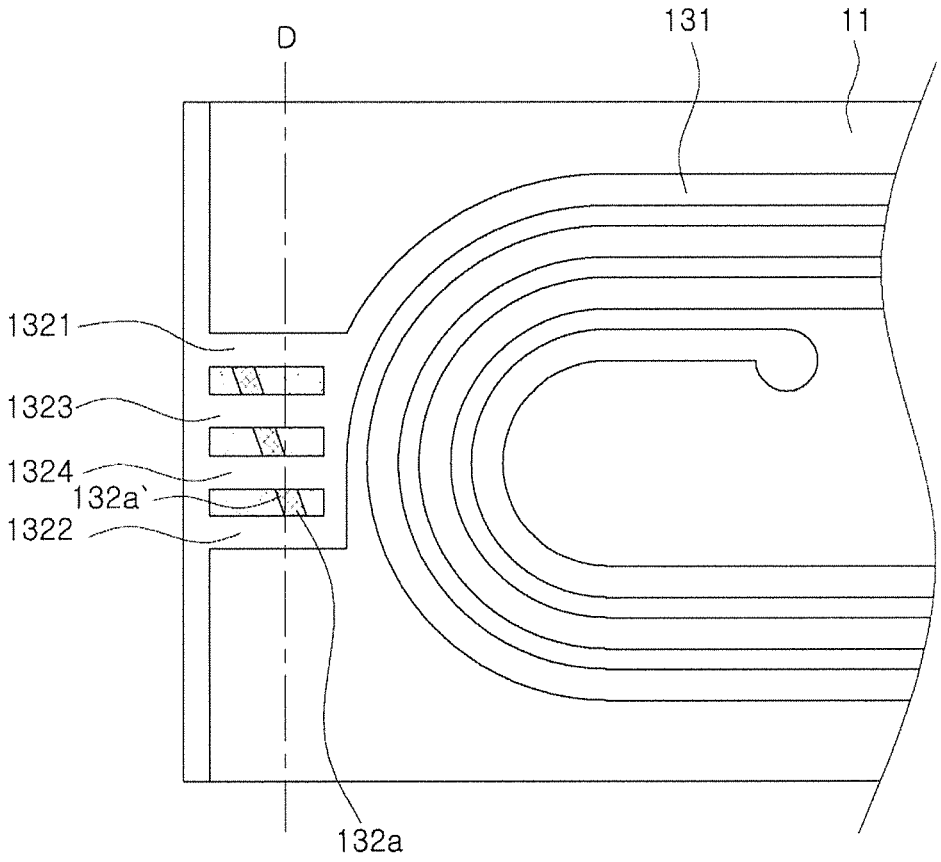
FIG. 5B is a portion of a schematic top view of FIG. 5A before dicing.

Next, FIG. 5A is a top view of a coil component 400 according to a third modified example of FIG. 2, and FIG. 5B is a portion of a schematic top view of FIG. 5A before dicing. Therefore, a dicing line D indicated by a dotted line is included in FIG. 5B. In describing FIGS. 5A and 5B, a description overlapping that of FIG. 2 will also be omitted for convenience of explanation, and the same reference numerals will be used to describe substantially the same configurations.

Referring to FIG. 5A, the coil component 400 may include third and fourth lead wires 1323 and 1324 parallel to first and second lead wires 1321 and 1322 between the first and second lead wires 1321 and 1322. The first to fourth lead wires may be disposed to be parallel to each other in the length direction and may be spaced apart from each other by a predetermined interval in the width direction.

Further, the coil component 400 may further include a first extension wire 132*a* disposed to have a predetermined angle (θ) with respect to the first to fourth lead wires 1321-1324. The angle (θ) between the first extension wire 132*a* and the plurality of lead wires is not limited as long as the angle is an acute angle smaller than a right angle, and the angle (θ) may be suitably set by those skilled in the art as needed. A contact area between a first external electrode and an internal coil may be increased by the first extension wire 132*a*, and substantially, an edge at which the first external electrode 21 and the internal coil 131 contact each other may be indicated by a thick solid line.

The first extension wire 132*a* may have a shape of a strip having a longer length before dicing, but only a portion of the strip may remain by the diced surface. A more detailed description will be provided with reference to FIG. 5B.

In FIG. 5B, a right side of the dicing surface D may be a region remaining in a form of a chip after the dicing (the region corresponds to the coil component of FIG. 5A), and a left side thereof may be a region except for the chip after the dicing. As illustrated in FIG. 5B, except for the first extension wire 132*a* remaining in the coil component 400, an extension portion 132*a*' of the first extension wire extended from the first extension wire may be further included. Here, since the extension portion 132*a*' of the first extension wire is a configuration removed after the dicing, in order to distinguish the extension portion of the first extension wire from other configurations that will remain, a prime symbol (') is added to the reference numeral at a right upper side. The extension portion 132*a*' of the first extension wire and the first extension wire 132*a* may be formed to have a shape of an oblique line elongated in the length direction, and thus, when a dicing blade operates while moving in the length direction, even though a moving width of the dicing blade is significantly large, a possibility that at least a portion of an extension piece will be secured may be increased. As a result, a possibility that a contact area between the first external electrode and the first lead portion will be increased may be increased.

Figure 6A:
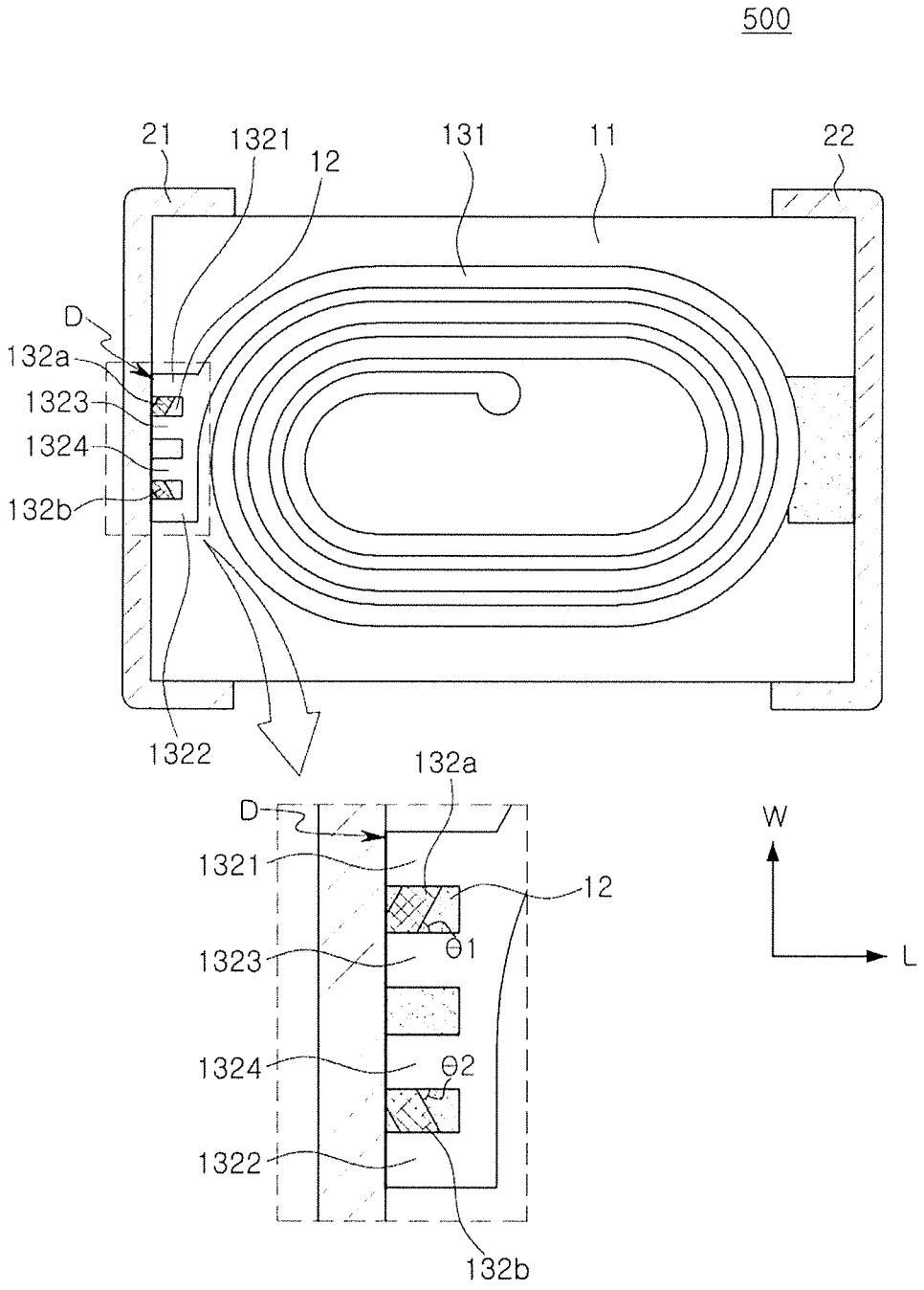
FIG. 6A is a top view of a coil component according to a fourth modified example of FIG. 2.
Figure 6B:
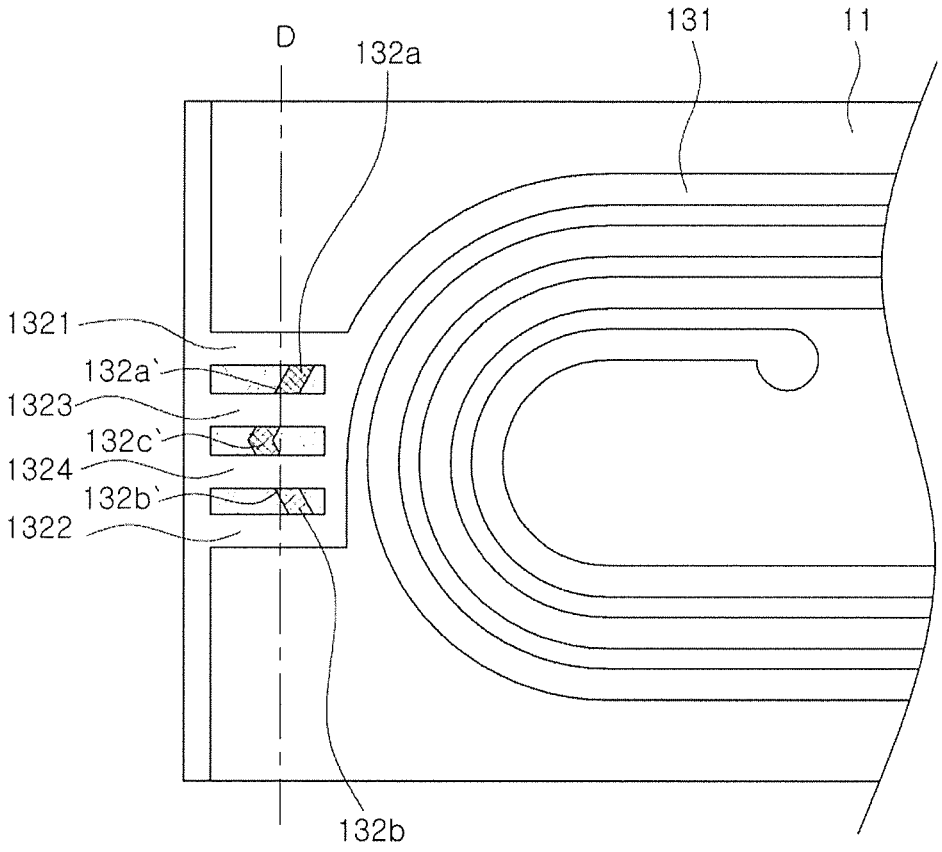
FIG. 6B is a portion of a schematic top view of FIG. 6A before dicing.

Next, FIG. 6A is a top view of a coil component 500 according to a fourth modified example of FIG. 2, and FIG. 6B is a portion of a schematic top view of FIG. 6A before dicing. Therefore, a dicing line D indicated by a dotted line is included in FIG. 6B. In describing FIGS. 6A and 6B, a description overlapping that of FIG. 2 will be omitted for convenience of explanation, and the same reference numerals will be used to describe substantially the same configurations.

Referring to FIG. 6A, the coil component 500 may include third and fourth lead wires 1323 and 1324 parallel to first and second lead wires 1321 and 1322 between the first and second lead wires 1321 and 1322. The first to fourth lead wires 1321-1324 may be disposed to be parallel to each other in the length direction and be spaced apart from each other by a predetermined interval in the width direction.

Further, the coil component 500 may further include first and second extension wires 132*a* and 132*b* disposed to have predetermined angles (θ1, θ2) with respect to the first to fourth lead wires 1321-1324, and the first and second extension wires 132*a* and 132*b* may be disposed to be discontinuous with each other. Describing the first and second extension wires 132*a* and 132*b* as a plurality of extension pieces, the angle (θ1) between the first extension wire 132*a* and the lead wire and the angle (θ2) between the second extension wire 132*b* and the lead wire are not limited as long as the angles (θ1 and θ2) are smaller than a right angle, and the angles (θ1 and θ2) may be suitably set by those skilled in the art as needed. Although not illustrated in detail, the angle between the first extension wire and at least one lead wire may be different from the angle between the second extension wire and at least one lead wire. A contact area between a first external electrode and an internal coil may be increased by the first and second extension wires 132*a* and 132*b*, and substantially, an edge at which the first external electrode and the internal coil contact each other may be indicated by a thick solid line.

The first and second extension wires 132*a* and 132*b* may be continuously connected to each other before the dicing but discontinuously remain by the diced surface D. A more detailed description thereof will be provided with reference to FIG. 6B. Here, the term "continuously connected to each other before the dicing" includes both a case in which there is a boundary line due to a difference in material and a case in which there is no boundary line due to uniformity of the material.

In FIG. 6B, a right side of the diced surface D may be a region remaining in a form of a chip after the dicing (the region corresponds to the coil component of FIG. 6A), and a left side thereof may be a region except for the chip after the dicing. As illustrated in FIG. 6B, except for the first and second extension wires 132*a* and 132*b* remaining in the coil component 500, extension portions 132*a*' and 132*b*' of the first and second extension wires extended from the first and second extension wires and a third extension portion 132*c*' may be further included. Here, since the extension portions 132*a*' and 132*b*' of the first and second extension wires and the third extension portion 132*c*' are configurations removed after the dicing, in order to distinguish the extension portions 132*a*' and 132*b*' of the first and second extension wires and the third extension portion 132*c*' from other configurations that will remain, a prime symbol (') is added to the reference numerals at right upper sides. The extension portion 132*a*' of the first extension wire, the first extension wire 132*a*, the second extension wire 132*b*, and the third extension portion 132*c*' may be formed to have an overall V shape, and thus when a dicing blade operates while moving in the length direction, even though a moving width of the dicing blade is significantly large, a possibility that at least a portion of extension pieces will be secured may be increased. As a result, a possibility that a contact area between the first external electrode and the first lead portion will be increased may be increased.

Except for the above-mentioned description, a description of the first lead portion of the coil component according to the exemplary embodiment in the present disclosure descried above may be applied to the second lead portion as it is, and for convenience of explanation, a detailed description of the second lead portion will be omitted.

With the coil component according to the present disclosure described above, the contact area between the external electrode and the internal coil may be secured as much as possible by improving a structure of the lead portion of the internal coil, such that an effect of decreasing direct current resistance (Rdc) and increasing adhesive force and an effect of securing plating uniformity by preventing over-plating may be implemented.

As set forth above, according to exemplary embodiments in the present disclosure, the coil component capable of improving the contact property between the external electrode and the lead wire of the internal coil to decrease direct current resistance (Rdc) and preventing over-plating to improve uniformity of the plating thickness may be provided.

While exemplary embodiments have been shown and described above, it will be apparent to those skilled in the art that modifications and variations could be made without departing from the scope of the present invention as defined by the appended claims.

What is claimed is:

1. A coil component comprising:

a body including a support member, an internal coil supported by the support member, and a magnetic material encapsulating the support member and the internal coil, and having upper and lower surfaces opposing each other in a thickness direction, first and second side surfaces opposing each other in a width direction, and first and second end surfaces opposing each other in a length direction; and first and second external electrodes disposed on external surfaces of the body, wherein the internal coil includes a coil body and first and second lead portions connected to one end portion and the other end portion of the coil body, respectively, the first lead portion includes first and second lead wires spaced apart from each other in the width direction and an opening portion between the first and second lead wires and the coil body, the opening portion being filled with the magnetic material, and the first lead portion includes at least one extension wire extending in a region between the first and second lead wires, and connected to the first external electrode.

2. The coil component of claim 1, wherein an angle of the at least one extension wire, with respect to the first and second lead wires is smaller than 180°.

3. The coil component of claim 1, wherein the second lead portion has a structure symmetrical to that of the first lead portion based on the center of the internal coil.

4. The coil component of claim 1, wherein at least one edge of the at least one extension wire is a dicing line.

5. The coil component of claim 1, further comprising at least one third lead wire, which is spaced apart from the first and second lead wires in the width direction and parallel to the first and second lead wires and is disposed between the first and second lead wires.

6. The coil component of claim 1, wherein the at least one extension wire is a single extension wire continuously formed between the first and second lead wires.

7. The coil component of claim 6, wherein a spaced distance between the first and second lead wires in the width direction is equal to or shorter than a length of an edge at which the extension wire and the first external electrode contact each other.

8. The coil component of claim 6, wherein a cross-section of the extension wire has a strip shape.

9. The coil component of claim 1, wherein the at least one extension wire includes a plurality of extension pieces discontinuously formed between the first and second lead wires and spaced apart from each other in at least one of the width and length directions.

10. The coil component of claim 9, wherein the plurality of extension pieces are symmetrical to each other in relation to a central line of the opening portion in the width direction.

11. The coil component of claim 9, wherein each of the plurality of extension pieces has a strip shape, and maximum widths of respective strip shapes are the same as each other.

12. The coil component of claim 9, wherein each of the plurality of extension pieces has a strip shape, and maximum widths of respective strip shapes are different from each other.

13. The coil component of claim 1, wherein the first and second lead wires and the at least one extension wire are disposed on the same plane.

14. The coil component of claim 1, wherein the first and second lead wires and the at least one extension wire are formed of the same material as each other.

15. The coil component of claim 1, wherein each of the first and second lead portions is composed of a base layer supported by the support member and directly contacting the support member and a plating layer on the base layer.

16. The coil component of claim 1, wherein the first and second lead wires, the at least one extension wire, and the coil body are formed integrally with each other without boundary surfaces therebetween.

17. A coil component comprising:

a body including a support member, an internal coil disposed on the support member, and a magnetic material encapsulating the support member and the internal coil; and first and second external electrodes respectively disposed on first and second surfaces of the body opposing each other in a length direction of the body, and connected to the internal coil respectively through first and second lead portions disposed on the support member, wherein the first lead portion has one or more holes filled with the magnetic material, at least one of the one or more holes of the first lead portion is spaced apart from the first external electrode by a conductive wiring of the first lead portion, the first and second lead portions are exposed from the first and second surfaces, respectively, and in the length direction, the conductive wiring of the first lead portion is disposed between the first external electrode and the one or more holes.

18. The coil component of claim 17, wherein the conductive wiring of the first lead portion is in direct contact with the first external electrode.

* * * * *